US008919498B2

(12) United States Patent
Maurer et al.

(10) Patent No.: US 8,919,498 B2
(45) Date of Patent: Dec. 30, 2014

(54) CLIMBING AID

(75) Inventors: Andreas Maurer, Zurich (CH); Pascal Mosetti, Niederlenz (CH); Dejan Trajkovic, St. Gallen (CH)

(73) Assignee: M & F Ingenieur Beratungs AG, Zurich (CH)

( * ) Notice: Subject to any disclaimer, the term of this patent is extended or adjusted under 35 U.S.C. 154(b) by 1369 days.

(21) Appl. No.: 12/092,880

(22) PCT Filed: Nov. 6, 2006

(86) PCT No.: PCT/CH2006/000622

§ 371 (c)(1),
(2), (4) Date: Sep. 20, 2008

(87) PCT Pub. No.: WO2007/051341

PCT Pub. Date: May 10, 2007

(65) Prior Publication Data

US 2009/0218165 A1 Sep. 3, 2009

(30) Foreign Application Priority Data

Nov. 7, 2005 (CH) ..... 1777/05

(51) Int. Cl.
*A63B 27/04* (2006.01)

(52) U.S. Cl.
CPC ..... *A63B 27/04* (2013.01); *A63B 2210/50* (2013.01); *A63B 2225/09* (2013.01)
USPC ..... 182/134; 182/90; 182/136; 182/9

(58) Field of Classification Search
CPC ..... A63B 27/02; A63B 27/04
USPC ..... 182/90–92, 8–9, 133–136, 189
See application file for complete search history.

(56) References Cited

U.S. PATENT DOCUMENTS 2,616,609 A * 11/1952 Herod ..... 182/8
3,968,858 A 7/1976 Vollan et al.

(Continued)

FOREIGN PATENT DOCUMENTS

DE 15 78 522 A1 8/1971
DE 29 32 707 A1 2/1981

(Continued)

OTHER PUBLICATIONS

International Search Report; International Application No. PCT/CH2006/000622; International Filing Date: Nov. 6, 2006 (Form PCT/ISA/220+210).

(Continued)

*Primary Examiner* — Daniel Cahn
(74) *Attorney, Agent, or Firm* — Antonelli, Terry, Stout & Kraus, LLP.

(57) ABSTRACT

An arrangement allowing a person to climb up and/or down an object, such as a high-voltage mast, the arrangement including an elongate, rail-type profiled element that is provided with at least one guiding part extending along the profiled element, and a part for absorbing force transmission. A climbing aid is also provided, comprising two climbing consoles with one respective foot supporting area and a guiding section that embraces or grips the guiding part and a holding section which at least partly rests against or on the profiled element opposite the guiding section.

6 Claims, 14 Drawing Sheets

(56) References Cited

U.S. PATENT DOCUMENTS

| | | | | |
|---|---|---|---|---|
| 4,085,818 | A * | 4/1978 | Swager | 182/48 |
| 4,572,329 | A * | 2/1986 | Kleveborn | 182/9 |
| 7,708,116 | B2 * | 5/2010 | Martin et al. | 182/8 |

FOREIGN PATENT DOCUMENTS

| | | | |
|---|---|---|---|
| DE | 102 01 965 | A1 | 7/2003 |
| EP | 1 506 799 | A | 2/2005 |
| FR | 2 343 492 | A | 11/1977 |
| FR | 2 547 859 | A | 12/1984 |
| FR | 2 639 314 | A1 | 5/1990 |
| FR | 2 839 303 | A | 11/2003 |
| WO | WO 94/19063 | A | 9/1994 |
| WO | WO 2005/016461 | A1 | 2/2005 |

OTHER PUBLICATIONS

Written Opinion; International Application No. PCT/CH2006/000622; International Filing Date: Nov. 6, 2006 (Form PCT/ISA/237).

International Preliminary Report on Patentability; International application No. PCT/CH2006/000622; International filing date: Nov. 6, 2006, Report issued Jun. 11, 2008.

Written Opinion of the International Searching Authority; International Application No. PCT/CH2006/000622; International filing date: Nov. 6, 2006.

* cited by examiner

CLIMBING AID

RELATED APPLICATION

This application is a U.S. national phase application under 35 U.S.C. §371 of International Application No. PCT/CH2006/000622 filed Nov. 6, 2006, which claims priority of Switzerland Application No. 1777/05 filed Nov. 7, 2005.

TECHNICAL FIELD

The present invention relates to an arrangement and/or a climbing aid for allowing a person to climb up and/or down an object.

BACKGROUND AND SUMMARY

Wherever large heights must be overcome, such as on chimneys, high buildings, silos, cable car poles, transmitting antennas, wind power plants, high-voltage towers, cranes, and the like, typically ladders are permanently mounted such that, for example, maintenance and repair work can be performed at all times. For example, in Germany alone hundreds of thousands of such high-voltage towers are used for power supply purposes, which are frequently provided with permanently installed ladders.

According to ladder and step-related accident statistics, annually about 40,000 falling accidents occur in Germany, of which 40 end fatally. Climbing up and down ladders is dangerous; a study conducted by the Technical University of Darmstadt, Germany, showed that about 70% of accidents occurred in connection with ladders that are permanently installed, with users frequently falling. A wide variety of ladder types are available, which are primarily based on the rung principle. When climbing up and down, the user must feel his way with his hands and feet from one rung to the next—and missing a grip or step is easily possible.

From U.S. Pat. No. 3,968,858, a climbing device is known, which comprises a foot platform for arranging both feet thereon and a hand grip for holding on to with both hands. The platform and the grip are held on a track, which is mounted, for example, to a mast of a sailboat. This device is suited for overcoming smaller heights, however not for high-voltage towers, because during climbing the foot platform must be pulled up with both arms and is then locked to the track.

From DE 102 01 965, a device for covering vertically upwardly directed sections is known. The invention describes a climbing aid operated by muscle power, which can be displaced upward and/or downward on a stationary ladder in the manner of a crawler.

Furthermore, WO 2005/016461 proposes an arrangement and/or climbing aid for the ascending and/or descending of a person. This climbing aid can both be manually operated or driven by means of a motor and allows a person to overcome great heights without difficulty. Both the climbing aid described in this international application and the one known from DE 102 01 965, however, are relatively large and heavy and cannot be transported by one person without difficulty. The climbing aids described in the two published prior art documents are rather suited for use with larger repair work, where additional tools are required anyhow, and not for the mobile, simple application, where an inspecting individual, for example, must perform routine checks.

It is therefore the object of the present invention to propose a climbing aid, which is particularly suited for overcoming large heights, is easily and universally employable, and which a person can transport without difficulty. Transportation may occur, for example, in a rucksack or another carrying vessel, whereas also a mobile use in difficult terrain becomes possible.

According to the invention, the object at hand is achieved by an arrangement according to the invention.

The proposed arrangement or system primarily comprises two elements, which is to say a rail-type, elongated profiled element and the actual climbing aid. The elongated, rail-type profiled element has a simple profile, which can preferably be fixed to an object to be climbed, such as a high-voltage tower, a mast of a cable car, and the like. The profiled element comprises guiding elements, such as at least one guiding part, which extends longitudinally along the profiled element and is suited for holding and guiding the climbing aid, and a part that is suitable for transmitting a force and/or absorbing the transmission of a force from the at least one climbing aid.

A core piece of the present invention are two climbing consoles, which are suited and provided for disposition on the elongated, rail-type profiled element and which enable a person to climb along the profiled element, for example on a high-voltage tower. The two climbing consoles each comprise a foot supporting surface and a guiding section that embraces or grips the guiding part on the profiled element, and furthermore comprises a holding section, which rests against or on the profiled element opposite to the guiding section and is suited to rest against or on the part for absorbing force transmission. The guiding part ensures that the climbing console on the one hand is held securely on the profiled element and cannot give way laterally, and on the other hand is guided securely on the profiled element during the motion along this element. The holding section guarantees that the climbing console is held tightly on the profiled element when the console is not being moved and prevents slipping of the person standing on the foot supporting surface along the profiled element. The guiding section and holding section are disposed on the climbing console such that, for example, tiltable or freely longitudinally displaceable arrangement of the console or the foot supporting surface on the profiled element in relation to the force transmitting part is possible such that the holding section, for example during the tilting motion, can be removed at least partially from the force transmitting section on the profiled element in order to enable displacement of the console along the profiled element.

It is also conceivable to dispose the guiding section and holding section on the console in a manner that they can be displaced toward or away from each other in a parallelogram-like manner such that climbing up or down is possible without a tilting motion of the foot support.

According to a further variant, a plurality of guiding sections are provided, for example as guiding rollers used on a carriage or cart-like device, which are disposed longitudinally displaceably on the profiled element, wherein the device is connected to the respective climbing console, for example, by means of a rotational axis. In addition, the holding section or sections are coupled in terms of motions to the respective climbing console, independently from the motions of the guiding section or sections, such that during an inclined or tilted position of the climbing console the holding section or sections are removed from the profiled element, and that the holding section or sections firmly rest against the profiled element in the resting position of the person or the corresponding foot, which is to say with a substantially perpendicular orientation of the respective console in relation to the profiled element. According to one variant, two holding sections are provided, which encompass the respective side of the profiled element in clamp or jaw-like manner.

The elongated, rail-type profiled element can be configured, for example, in a U-shaped, T-shaped, H-shaped manner or the like, for example having leg-like and/or pipe-like guiding parts on the sides, which the guiding section of each console can embrace or grip.

If, for example, the profiled element, as it is described in WO 2005/016461, comprises tongue-like or grid-like longitudinal guides or recesses, it is possible, for example, to provide engaging parts or pawl-like locking means protruding on the holding section or to provide the supporting surface on the holding section with convexities or cams, which engage in the grid-like or toothed rack-like notches or openings of the profiled element when fixing the climbing console in place, for example at least substantially in a locking manner. It is also possible, however, that the supporting surface of the holding section is configured to be rough or, for example, partially elastic in order to enable retention as a result of high frictional forces.

Further preferred variants, particularly of the climbing consoles, are described below.

The climbing consoles according to the invention in particular are suited for use together with an elongated, rail-type profiled element, as is described in WO 2005/016461, for example. By using the inventive climbing consoles, it is possible, instead of the high-standard climbing consoles comprising also a foot platform, handles, drive mechanisms and the like described in WO 2005/016461, to use simple climbing consoles, which a person can carry, for example, in a bag, a rucksack or just in general in a mobile manner, in order to then use them, for example on a high-voltage tower, to climb along the profiled element claimed according to the invention.

In addition to the climbing consoles described according to the invention, advantageously further holding elements may be used, by means of which the climbing person can hold on to the profiled element or a high-voltage tower, the elements being in part known well from conventional climbing devices. These may be collar-like holding elements, which can be mounted to the profiled element, or placed around cable-like holding elements, which in turn can be placed, for example, around the high-voltage towers, and the like. These additionally known holding elements for holding the climbing person by means of the hands, or by means of securing elements placed around the person, for example on the back, or disposed on the belt strap, are not primary components of the present invention and therefore these elements will not be addressed in further detail. Instead, the present invention proposes a fall protection safety device for persons, which is advantageously also suited for the combined use with the above-described climbing consoles.

The carriage or cart-like safety device, which is freely longitudinally displaceable on the profiled element along the profiled element, embracing the same at least partially from the outside. The safety device comprises a locking device, which can be connected to a person climbing up or down the profiled element such that the longitudinally displaceable safety device is locked during a potential fall that may occur.

For this purpose, it is proposed to provide a pawl engaging on or in the profiled element, wherein the pawl immediately engages in the profiled element if tensile forces occur from the profiled element as a result of the connection of the person to be secured, for example vertically outward or in the case of downwardly directed forces, and locks the safety device.

The invention will be explained in more detail by way of examples and with reference to the enclosed figures.

DETAILED DESCRIPTION

Figure 1:
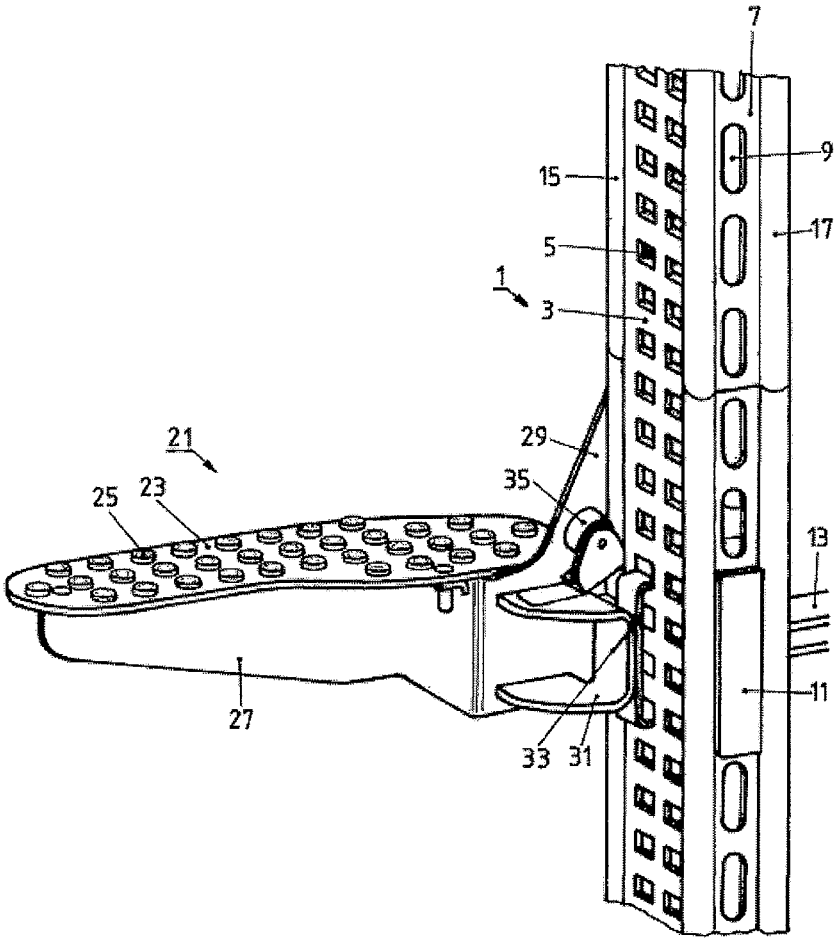
FIG. 1 is a schematic side perspective view of an inventive climbing console, which is disposed on a longitudinal profile.
Figure 2:
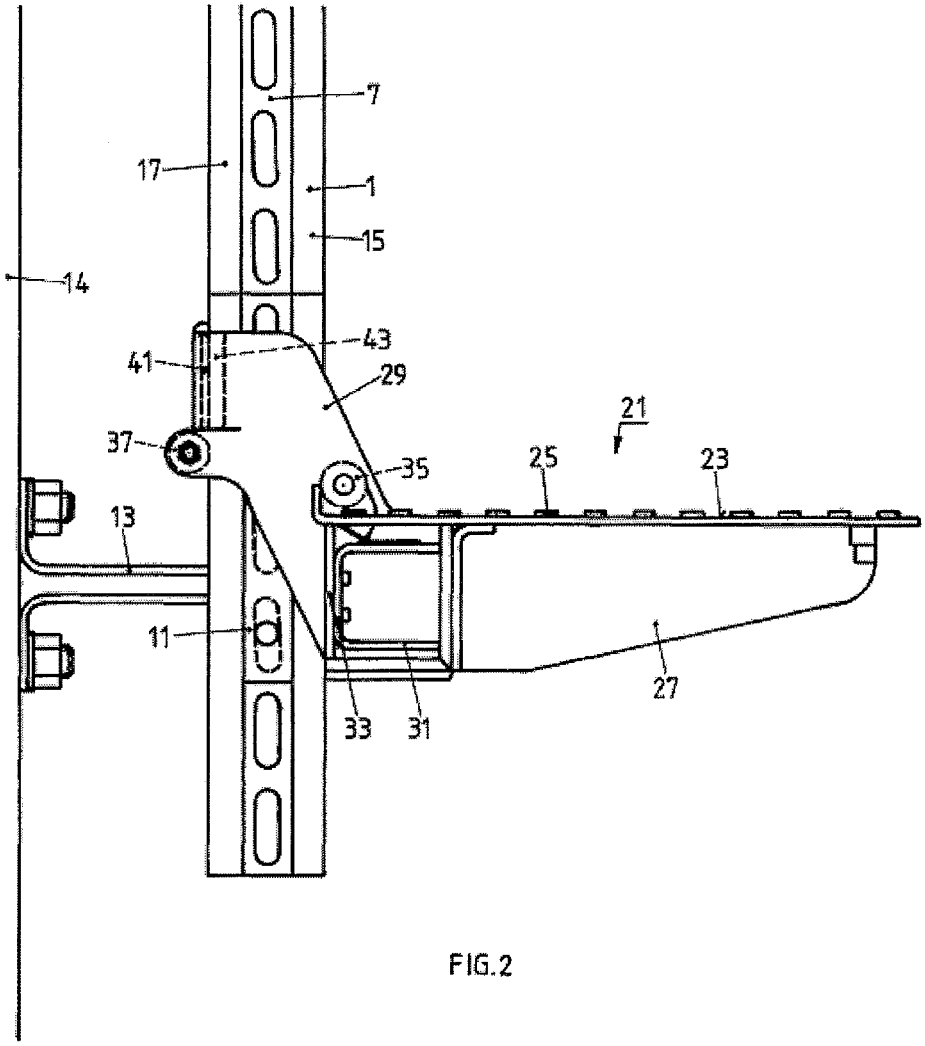
FIG. 2 shows the inventive climbing console in a side view in the holding position.
Figure 14:
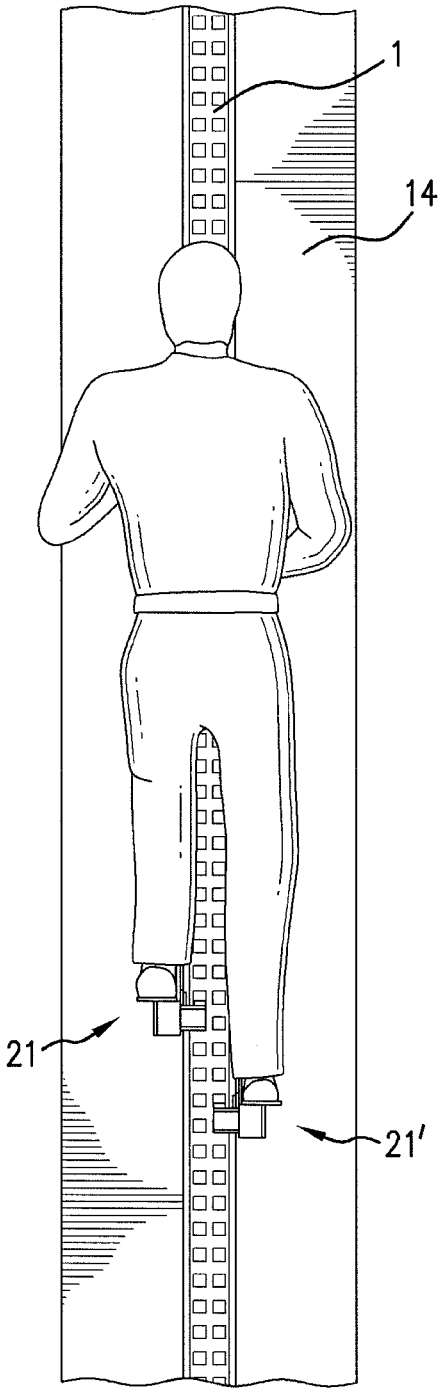
FIG. 14 is a schematic front view of two climbing consoles according to the invention in use on respective sides of the profiled element according to the invention shown in use by a person climbing up or down an object with the arrangement.

FIG. 1 shows a schematic perspective side view of an arrangement according to the invention for allowing a person to climb up and/or down an object, such as a high-voltage tower, 14 in FIGS. 2 and 14, on which an elongated, U-shaped profiled element 1 is disposed. In the base surface 3, the elongated profiled element 1 has toothed rack-like grid openings 5, the function of which will be described below. In the side surfaces 7, openings 9 are provided, in which mounting elements 11 can be firmly disposed in order to fix the profiled element 1 to the high-voltage tower 14 via fastening means 13 as shown in FIG. 2.

It is possible to provide a climbing console 21 on this profiled element 1 in a mobile and detachable manner, wherein the console comprises a foot supporting surface 23 having nubs 25, for example as holding elements in order to enable a user to position himself in a slip-proof manner on the supporting surface 23. Beneath the support 23, a reinforcement rib 27 is provided, which is connected via a fastening member 29 to the guiding section, which is not shown in FIG. 1. Instead, on the front of the profiled element a brace 31 is shown, on the front of which a holding section 33 is provided in order to engage in the toothed rack-like grid openings 5 of the base surface 3 of the profiled element, the openings 5 and base surface 3 constituting at least one part for absorbing force transmission onto the profiled element and guiding part 15 thereof as discussed below. In order to guarantee particularly safely guided movement of the console 21 along the profiled element, furthermore a guiding roller 35 is disposed above the holding section 33.

Additionally, it should be mentioned that of course two consoles must be used for climbing up or down, however the figures always only show one console, except shown schematically in FIG. 14 are two consoles, 21 and 21' of the type disclosed herein arranged on respective sides of the disclosed profiled element 1 according to the invention in use by a person climbing an object, high-voltage tower 14.

FIG. 2 shows the console and the profiled element according to FIG. 1 in a side view, wherein again the brace 31 comprising the holding section 33 disposed on the front thereof is clearly apparent.

It is also apparent from FIG. 2 that pipe-like elements are disposed as guiding or holding pipes 15 and 17 laterally on the sides 7 of the profiled element 1, wherein, for example, two guiding rollers 35 and 37 are disposed on the console 21 so as to engage in the pipes. The fastening member 29 terminally embraces the guiding pipe 17 disposed at the end of the side surface 7 by means the two parts 41 and 43, wherein the embracing part 43 is bent on the rear of the side surface 7 such that the console 21 cannot give way laterally from the profiled way.

Figure 3:
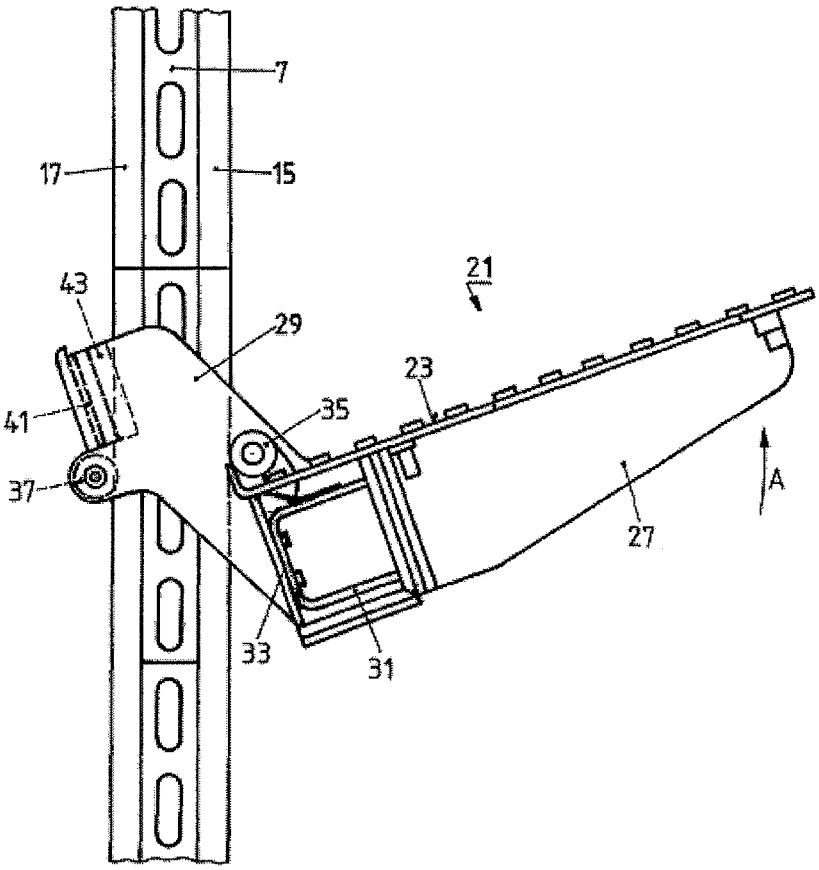
FIG. 3 is a climbing console according to the invention on a profiled section in a position in which a person climbs up or down.

In order to enable a person to climb along the profiled element 1 up a high-voltage tower, the console 21 can be "tilted" or disposed at an incline to the profiled element 1, which is shown schematically in the side view in FIG. 3. By tilting the console 21, the holding surface or the holding section 33 engaging in the tooth-like grid openings 5 provided in the base surface 3 is displaced away, as a result of which the console can be displaced in the longitudinal direction along the profiled element. This tilting also causes the two guiding rollers 35 and 37 to assume "snug" engaging positions along the two guiding or holding pipes 15 and 17 such that safely guided displacement of the console 21 along the profiled part becomes possible. In this context, it may be advantageous to prestress the two guiding rollers 35 and 37 in relation to the two guiding pipes 15 and 17 by means of a spring force in order to guarantee snug engagement. In addition, also the bent part 43 embracing the side surface 7 should be dimensioned such that the climbing console still cannot give way laterally.

In FIGS. 1 to 3, the illustration of a holding buckle, a holding strap, or a quick-release fastener, for example, such as detachable punched or snowboard-type fastenings, was foregone, by means of which the foot of a user is held firmly on the supporting surface 23. Of course it is evident that such holding means are advantageous and/or necessary to ensure that the console is "pulled along" as the user performs the climb.

Figure 4:
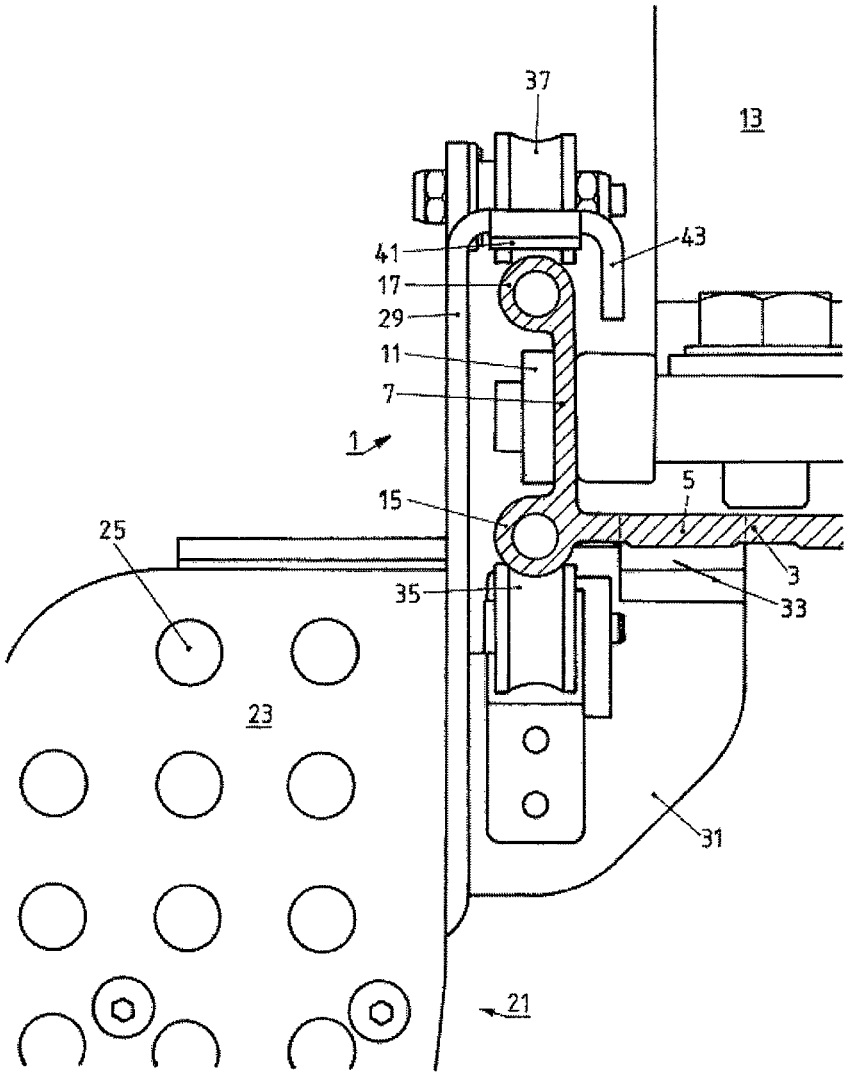
FIG. 4 is a schematic view of a cross-sectional half of a lateral guiding side of the profiled element, together with a guiding part and holding part, engaging in the lateral side of the profiled element.

FIG. 4 shows a cross-sectional half of a side of the profiled element 1, illustrating a possible embodiment variant of both the guiding section and the holding section of a climbing console 21. In the illustration according to FIG. 4, the two guiding rollers 35 and 37 ensure secure longitudinal guidance of the console along the two guiding or holding pipes 15 and 17 of the profiled element 1.

Figure 5:
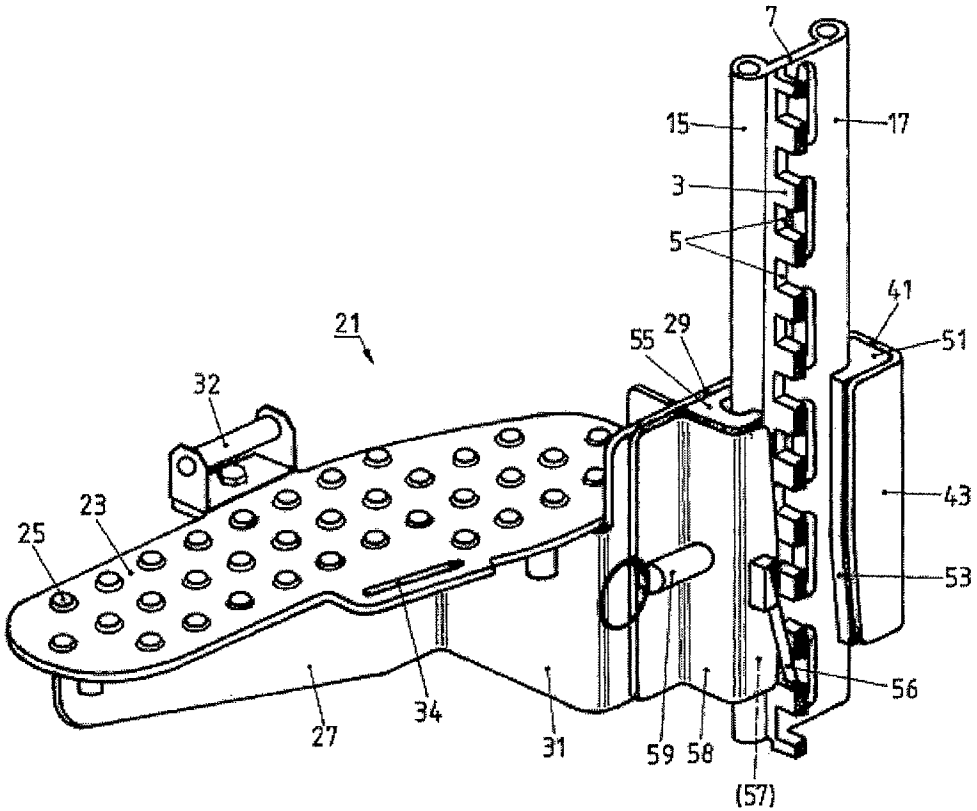
FIG. 5 is a schematic side perspective view of a further climbing console according to the invention, which is disposed on a longitudinal profile.

FIG. 5 is a side perspective view of a further possible variant of a climbing console according to the invention, which is disposed on a longitudinal profiled element for climbing high-voltage towers, for example. FIG. 5 again only shows one climbing console, and also of the profiled element only the corresponding half is shown in a perspective view. The climbing console 21 again has a foot supporting surface 23 comprising nubs 25 disposed thereon, and additionally also the fastening sections 32 and 34 are shown in schematic illustrations, which are used, for example, to provide foot holding straps. The foot support 23 is connected via a reinforcement rib 27, fastening member 29 and brace 31 to the appropriate elements or members, by means of which the support is held on the elongated profiled element. Of the profiled element, the side 7, the two guiding or holding or force transmitting pipes 15 and 17, as well as the front side surface 3 and the grid or toothed wheel-like recesses or openings 5 provided therein are shown. In the extension of the fastening member 29, the guiding pipe 17 is embraced by the two parts 41 and 43, similar to the preceding illustrations, wherein in the embodiment according to FIG. 5 no guiding rollers are provided. Instead, on the inside a guiding or holding support surface 51 is provided on the two parts 41 and 43, and in the lower part an angled sliding section 53 is disposed.

Similarly, on the opposite side, a holding section 57, which embraces or engages in the holding or guiding pipe 15 and is not shown in FIG. 5, and a further sliding section are provided, the section being disposed above and at an incline thereto and denoted with reference numeral 55. Both the holding section 57 and the further sliding section 55 are held on the inside in a cover or casing element 58, which is disposed longitudinally displaceably in relation to and on the fastening member 29. This longitudinal displaceability is advantageous, for example, in order to dispose or fasten the console 21 on the side wall 7 of the profiled element or to remove the console again from the side wall. By pulling, for example, a locking pin 59, the cover 58 can be removed from the holding or guiding pipe 15, thus enabling removal of the console 21 from the side wall. Vice versa, the locking pin 59 can be used to firmly lock the cover or casing 58 in order to prevent lateral removal of the console 21. According to a further embodiment, however, it is also possible to rigidly dispose the cover or casing 58 on the fastening member 29, and removal of the console 21 is enabled in that the locking pin 59 is pulled and consequently the holding section 57 can be removed from the cover 58 toward the top or bottom. Similarly, when arranging the console, the holding section 57 is inserted from above or beneath into the region between the holding pipe 15 and the cover 58 and fixed in place by means of the locking pin 59.

Finally, a pawl 56 is apparent, the function of which will be addressed hereinafter with reference to FIG. 6.

Figure 6:
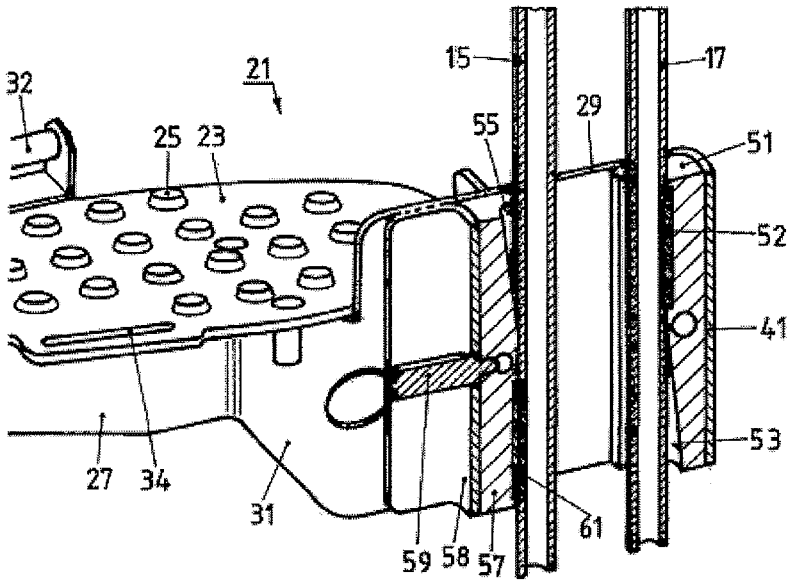
FIG. 6 shows sections of the climbing console according to FIG. 5, illustrating the fastening on the profiled element.

Based on FIG. 6, the operating principle of the console according to FIG. 5 is to be used to explain in detail particularly how the console 21 according to FIG. 5 can be used to climb up and/or down along the profiled element. FIG. 6 shows a cut view of a section of the region of the holding sections of the console, which engage on or in the two guiding or holding pipes 15 and 17.

Since it is a cut view, the parts embracing the guiding or holding pipes 15 and 17 have been omitted, so that the guiding or holding section 51 embracing the guiding pipe 17 on the back is apparent, having a special highly abrasion resistant coating on the front toward the guiding pipe 17 and/or an insert element 52 with particularly good adhesion properties, for example comprising an accordingly highly abrasion resistant polymer. Conceivable are, for example, special rubber materials, which are known from brake linings, for example, such as partially cross-linked PU, and the like, or a polymer filled or reinforced with carbon fibers or aramide fibers, such as polypropylene, polyamide, PU, or the like. This guiding or holding section 51 comprises a sliding section 53 disposed at an angle thereto and extending downwardly toward the front, wherein the sliding section in conjunction with an accordingly slanted sliding section 55 on the opposing holding section 57 enables an inclined position or an upwardly tilted position of the console 21. On the opposing holding section 57, resting against the holding or guiding pipe 15, on the front a highly abrasion resistant coating 61 is provided, which in turn comprises the above-mentioned materials or another suitable polymer. The two coatings 61 and 52 furthermore have such surface properties that good adhesive action is achieved on the two pipes 15 and 17 in the "non-usage position" of the console 21. In order to ensure that additionally in the "non-usage position" the console cannot slide downward, it is advantageous that a pawl 56 engages in the gear wheel or grid openings 5, which is shown in FIG. 5. This pawl 56 may be, for example, slightly prestressed by spring action in the direction toward the toothed rack such that it automatically engages in a gear wheel opening in the horizontal position of the console 21. When climbing up or down, however, which is to say in the inclined position of the console 21, this pawl slides along the toothed rack as a result of the inclined position, without engaging the rack.

FIG. 6 again shows the locking pin 59, by means of which the casing 58 and the holding section 57 connected thereto can be pulled off the holding or guiding pipe 15 such that lateral removal of the console from the profiled element becomes possible.

Figure 7:
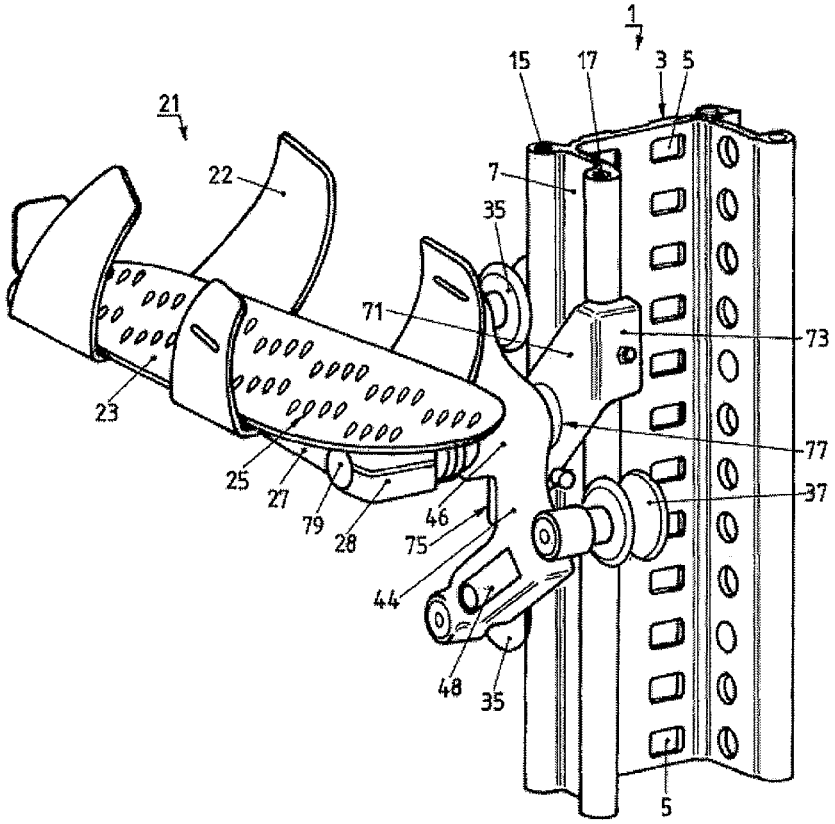
FIG. 7 is a lateral perspective view of a further variant of a climbing console according to the invention.

FIG. 7 is a side perspective view of a further embodiment of an inventive console 21, which is disposed on a profiled element 1. Contrary to the above examples, in the variant according to FIG. 7 three guiding rollers 35 and 37 are provided, which are disposed freely longitudinally displaceably along a side 7 of the profiled element 1 and/or along the two pipes 15 and 17. The cart-like device 44 connecting the rollers 35 and 37 comprises at the center a sleeve-like rotary body 46, through which a rotational axis connection 79 extends, connecting the climbing console 21 to a clamp-like device 71, which comprises two jaws 73 and 75, which are configured on the clamp 71 in a parallelogram-like manner. The two jaws 73 and 75 are configured such that they rest against each of the two pipes 15 and 17 in a clamping manner, embracing the pipes from the outside, when the climbing console, as is shown in FIG. 7, is in the non-usage position. The connecting axis 79 is seated in a corresponding mount 28 of the climbing console, which is provided on the front of the reinforcement rib 27. The remaining parts of the climbing console are designated with the same reference numerals as the climbing consoles in the preceding figures. The only additional part shown is a loop-like holding device 22, which is provided in order to keep the foot of a climber firmly on the console.

Figure 8:
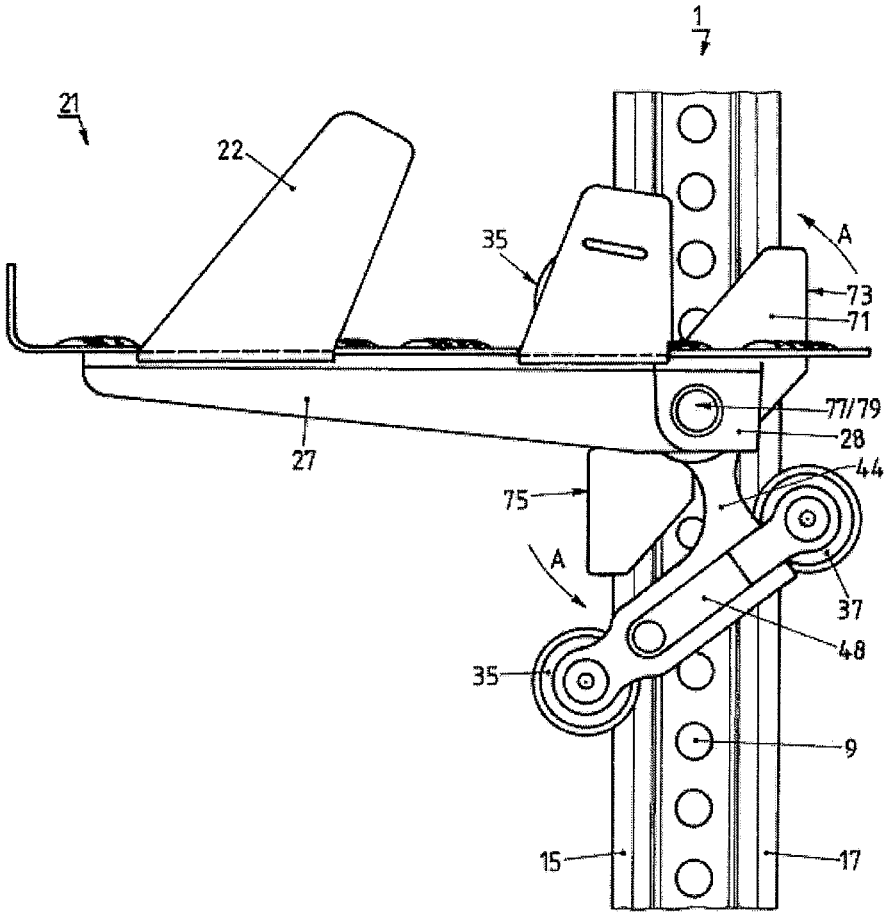
FIG. 8 shows a side top view of the climbing console according to FIG. 7 in a non-usage or clamping position.

FIG. 8 shows the climbing console according to FIG. 7 in a side view, which is again in the non-usage position or clamping position, which is to say that the climbing console is held firmly on the profiled element 1. As is apparent from FIG. 8, this is achieved by means of the clamp 71, which is driven in the direction of arrow A based on the coupling of motions and the inherent weight of the person standing on the console 21, as a result of which the clamp 71 is firmly "anchored" on the profiled element by means of the two jaws 73 and 75.

Figure 9:
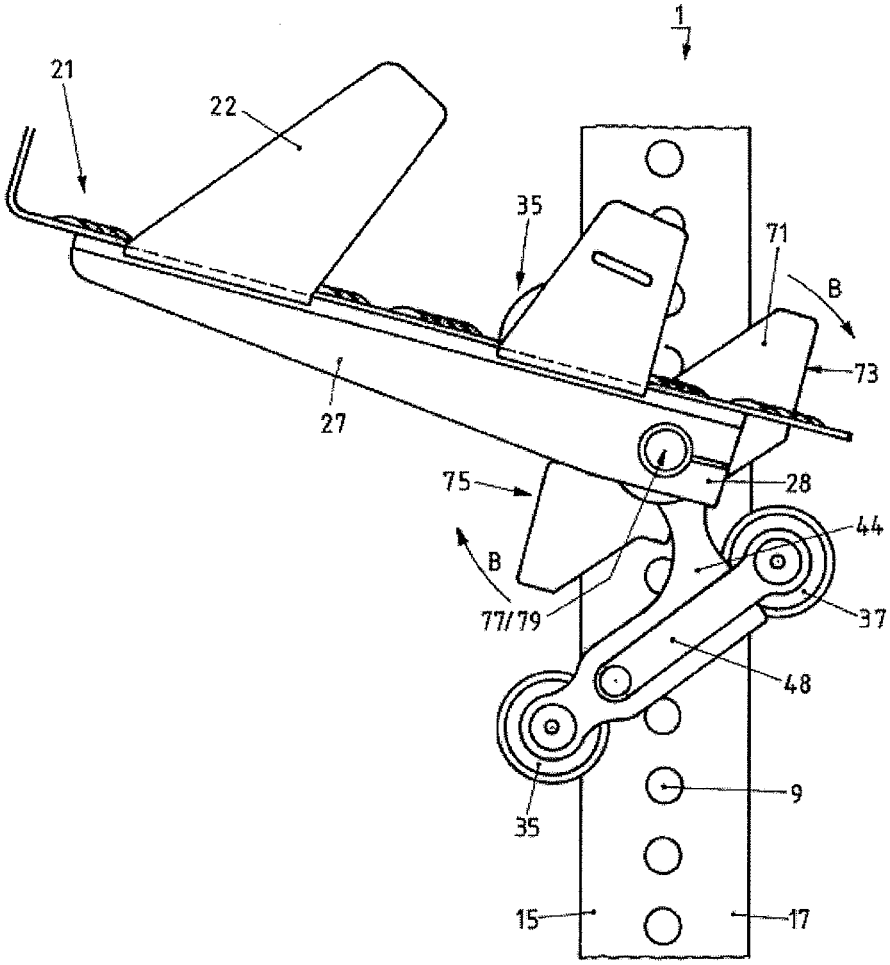
FIG. 9 shows a side top view of the climbing console according to FIG. 7 in an inclined position during up or down movement.

FIG. 9 shows a side top view of the climbing console according to FIG. 7 in an inclined, tilted position, which is suitable for the ascent or descent of a person. As a result of the inclined position of the console 21, also the clamp is swiveled in the direction of arrow B, thus swiveling the two jaws 73 and 75 away from the respective profiled element pipes 15 and 17. Now the cart-like device 44 can be displaced along the profiled element by means of the guiding rollers 35 and 37. As soon as the person has passed a sufficiently large path upward or downward with the leg whose foot is standing on the illustrated console 21, the console is again moved into the position according to FIG. 8 and the console is clamped firmly to the profiled element 1. In order to support the backward motion in the non-usage position, the connecting axis 79 is preferably prestressed by spring action such that the console automatically moves into the non-usage position if no force is applied on the console, for example by the foot of the person.

For arranging the climbing console, as illustrated in FIGS. 7 to 9, on the profiled element, it is further provided that the guiding roller 37 can be swiveled away laterally, for example by pressing in a clamping device 48, which is particularly apparent in FIGS. 8 and 9. This clamping device is prestressed by spring action in the clamping direction such that automatic swiveling of the roller 37, for example during the ascent or descent of a person, is made impossible.

FIGS. 10 to 13 describe a fall protection device for a person, which is particularly suited for the combined use with a climbing console, as that described above with reference to FIGS. 1 to 9. However, the illustrated fall protection device for a person can also be used in conjunction with other climbing devices, provided that a profiled element according to the invention is available.

Figure 10:
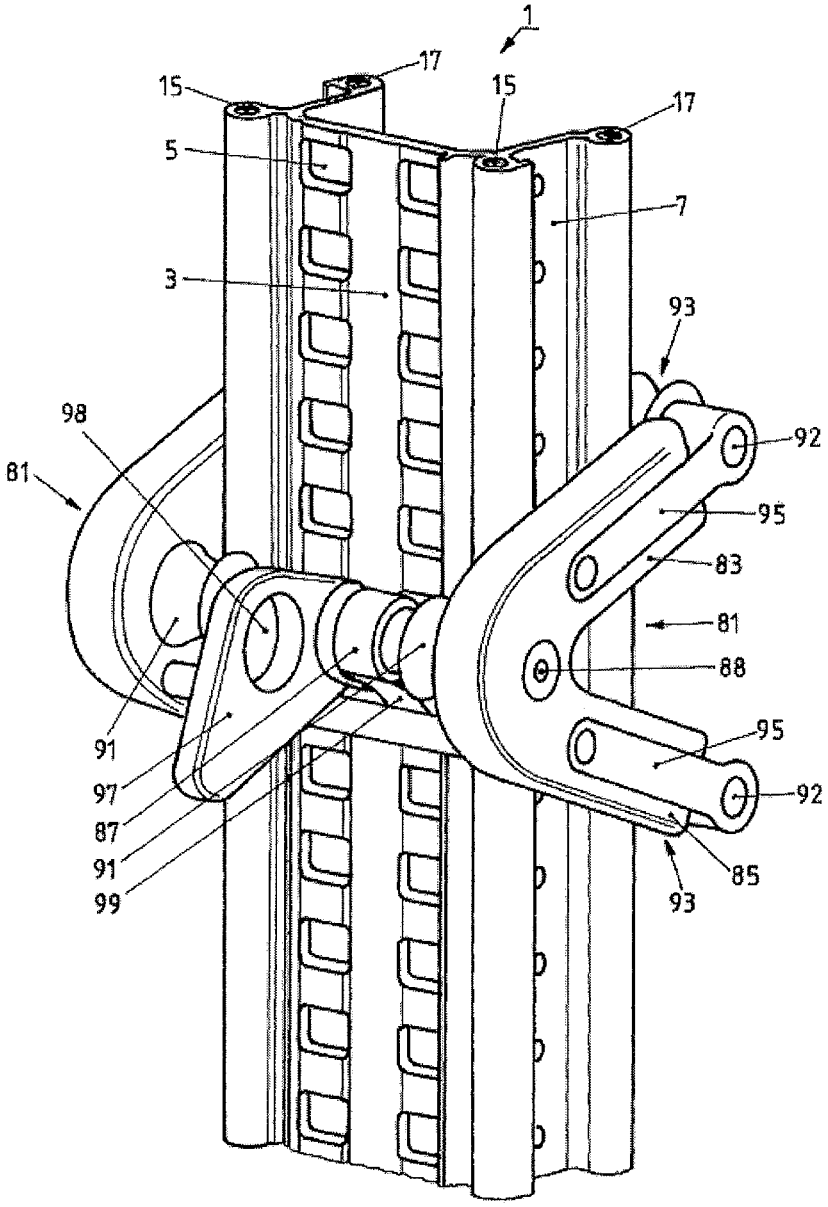
FIG. 10 is a perspective illustration of a possible variant of an inventive fall protection device for a person.

FIG. 10 shows the fall protection device 81 for a person in an oblique front perspective view, comprising two lateral sides 83 and 85 disposed at an angle to each other, wherein the sides are connected at the front to one another via an axle connection 88. At the back, rollers 93 are provided at the ends of the two sides 83 and 85 in order to guide the fall protection device 81 for a person along the pipe 17 at the back. The rollers 93 are held on the sides 83 and 85 in the appropriate roll axles 92. On the front, which is to say for guidance along the two pipes 15, further rollers 91 are disposed along the connecting axle 88. At the center of the axle 88, a locking device 97 is provided, which comprises a fastening eyelet 98 for disposing a safety cable for a person, who is climbing up or down along the profiled element 1, for example using the above-described climbing consoles. Finally, the locking device 97 is provided with a pawl 99, which is non-rotatably connected to the locking device 97 by means of a collar 87.

Figure 11:
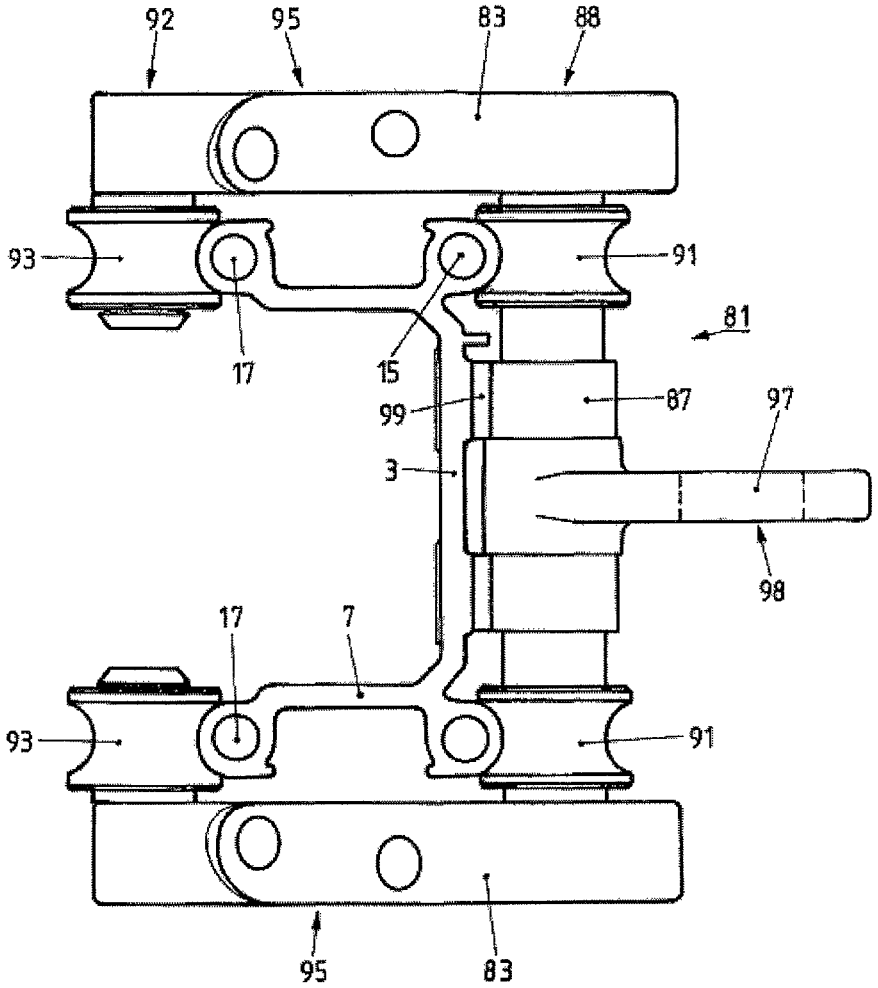
FIG. 11 shows a cross-sectional view of the falling protection device for persons according to FIG. 10 in relation to the profiled element.

FIG. 11 shows the fall protection device 81 for a person based on a cross-section of the profiled element 1, wherein the rollers 91 and 93 embracing the two sides 7 of the profiled element from the outside are very apparent.

Figure 12:
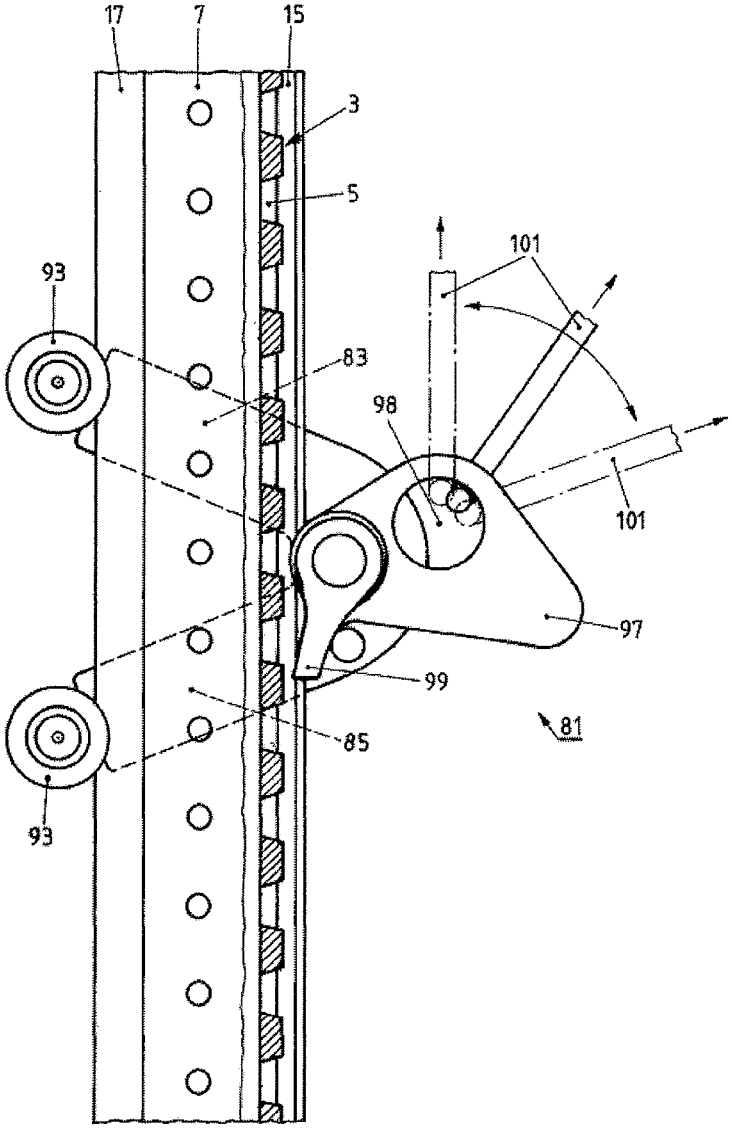
FIG. 12 shows a schematic side view of the falling protection device for persons according to FIG. 10 in an unlocked state, with a controlled up or down movement of the person.
Figure 13:
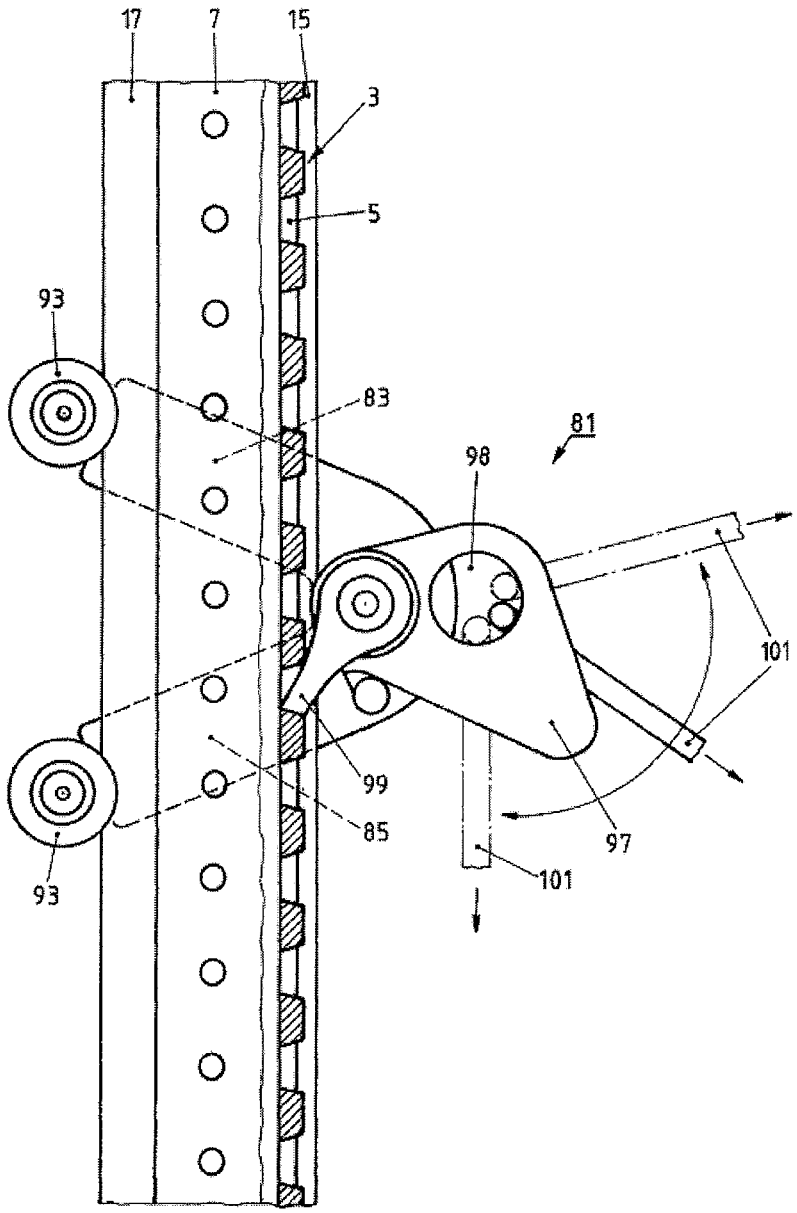
FIG. 13 is a schematic side view of the fall protection device for persons according to FIG. 10 in a secured state in a resting position of a person or in a position to prevent a fall.

FIG. 12 shows the fall protection device for a person in a side perspective view and the two sides 83 and 85 in a transparent illustration in order to provide a better picture of the operating principle of the locking device. If only one person climbs up or down along a profiled element, the safety cable 101 is located in the eyelet 98 of the locking device 97 in the upwardly inclined position according to FIG. 12. Due to the rotational coupling with the locking device, the pawl 99 is accordingly removed from the grid of openings 5 of the toothed rack-like device 3, and the fall protection device for a person can be moved freely up or down. If for any reason the ascending or descending person should slip from the climbing consoles, or if the climbing console is not sufficiently attached to the profiled element, the safety cable is automatically displaced downward from the upwardly inclined position, which is shown in FIG. 13.

Due to prestressing, which is brought about by a spring, for example, the locking device 97 and the pawl 99 connected thereto are automatically displaced in the direction of the profiled element, thus causing the pawl 99 to engage in one of the grid openings 5. This action locks the fall protection device 81 for a person, and it cannot be moved downward. The person connected to the safety cable 101 is protected from a potential fall. In order to dispose the fall protection device on the profiled element, it is possible, for example, to swivel the rear rollers 93 outward and away, for example by actuating a holding clamp 95, which locks the rollers in the operating position.

Instead of the roller-type guides 83 and 85 shown in FIGS. 10 to 13, of course also the sliding surfaces can be provided, which enable longitudinal displaceability of the fall protection device 81 for a person. Instead of three rollers, for example, also only two guiding sliding surfaces may be provided on either side, or the like. The only essential aspect is that a locking device is provided, which has an engaging section for engaging in the toothed rack-like grid, which is prestressed such that in the event of a fall automatic locking of the fall protection device for a person is triggered.

The variants shown in FIGS. 1 to 13 are, of course, only examples, which can be modified, supplemented and amended in any arbitrary manner. For example, particularly the material selection was not specifically addressed and metals, such as steel, aluminum and the like, can be used particularly for the foot support and reinforcement elements, while for the guiding rollers, holding section, guiding section both metallic materials and polymer materials are possible, such as highly abrasion resistant thermoplastics, specially partially cross-linked polyurethanes (PU), highly cross-linked silicons, and the like. It is also possible to use different longitudinal profiles, such as U-profiles, T-profiles, H-profiles, L-profiles, and the like, both such having the holes or toothed rack-like grids shown in the figures and also longitudinal profiles having no such holes, but having, for example, rough surfaces and the like. With respect to the profiled element, reference is made to WO 2005/016461, the content of which, to the extent it relates to the profiled element, is hereby included as an integral part of the present invention. Of course it is also possible to configure the climbing console or the fall protection device such that the holding section engages on or in the jaws or that the pawl engages in the side surfaces and/or the holding or guiding pipes of the profiled element in order to firmly position the climbing console.

Finally, as was already mentioned above, the description of further securing elements is foregone, which of course are useful, advantageous and may even be required, in order to guarantee additional firm bracing for a user when climbing a high-voltage tower, for example. These can be that they engage on or in the longitudinal profile, cable- or strap-like elements, which can be placed around the high-voltage tower, and the like.

The invention claimed is:

1. An arrangement for allowing a person to climb up and down an object, the arrangement comprising:

at least one elongated profiled element including a first side and a second side, the first side having first and second elongated guiding parts extending along the profiled element and a first part for absorbing force transmission onto the profiled element and the first and second elongated guiding parts, and the second side having third and fourth elongated guiding parts extending along the profiled element and a second part for absorbing force transmission onto the profiled element and the third and fourth elongated guiding parts, a climbing aid including first and second climbing consoles, the first climbing console being located on the first side of the profiled element and having a first foot supporting surface, first and second guiding rollers and a first holding section, the first guiding roller gripping from outside of the profiled element a first one of the first and second elongated guiding parts, the second guiding roller gripping from outside of the profiled element a second one of the first and second elongated guiding parts, and the first holding section resting against or on the first part at a position outside of the profiled element located at least partially opposite from a position of the first guiding roller, the second climbing console being located on the second side of the profiled element and having a second foot supporting surface, third and fourth guiding rollers and a second holding section, the third guiding roller gripping from outside of the profiled element a first one of the third and fourth elongated parts, the fourth guiding roller gripping from outside of the profiled element a second one of the third and fourth elongated guiding parts so that the third and fourth elongated parts are positioned within said third and fourth rollers, and the second holding section resting against or on the second part at a position outside of the profiled element located at least partially opposite from a position of the third guiding roller, a safety device for securing the person climbing up and down along the profiled element, the safety device having a carriage, which is longitudinally displaceable on and along the profiled element, embracing the profiled element at least partially from outside of the profiled element, and the carriage including a locking device configured to be connected to the person, the locking device further configured to lock the carriage in place on the profiled element as a direct result of a fall by the person, wherein the first guiding roller of the first climbing console is disposed at a distance from the first holding section such that the first climbing console is configured to tilt with respect to the profiled element such that the first holding section can be removed from a locked position with the first part of the profiled element in order to enable displacement of the first climbing console along the profiled element, and wherein the third guiding roller of the second climbing console is disposed at a distance from the second holding section such that the second climbing console is configured to tilt with respect to the profiled element such that the second holding section can be removed from a locked position with the second part of the profiled element in order to enable displacement of the second climbing console along the profiled element.

2. The arrangement according to claim 1, wherein the profiled element has a profile configuration selected from the group consisting of U-shaped and H-shaped.

3. The arrangement according to claim 1, wherein said guiding rollers grip said elongated guiding parts in order to enable the climbing consoles to have secure positioning and longitudinal guidance with respect to the profiled element while moving along the profiled element.

4. The arrangement according to claim 1, wherein the first guiding roller is disposed at said distance from the first holding section such that the first climbing console is configured to be removed from the profiled element when tilted away from the profiled element by an angle greater than 45 degrees, and wherein the third guiding roller is disposed at said distance from the second holding section such that the second climbing console is configured to be removed from the profiled element when tilted away from the profiled element by an angle greater than 45 degrees.

5. The arrangement according to claim 1, wherein said first and second parts for absorbing force transmission are each formed by at least one toothed rack or grid longitudinal guide.

6. The arrangement according to claim 1, further comprising holding elements on the foot supporting surfaces of the two climbing consoles to enable secure positioning of a user on the foot supporting surfaces.

* * * * *